United States Patent [19]

Hanekom et al.

[11] 3,994,681

[45] Nov. 30, 1976

[54] OXIDATION OF WOOL AND LIKE KERATIN FIBRES

[75] Inventors: Edwin Charles Hanekom; Francois Albertus Barkhuysen, both of Port Elizabeth, South Africa

[73] Assignee: South African Wool Board, Pretoria, South Africa

[22] Filed: Apr. 8, 1975

[21] Appl. No.: 566,134

[30] Foreign Application Priority Data

Apr. 9, 1974 South Africa ..... 74/2248

[52] U.S. Cl. ..... 8/128 R; 8/127.51; 8/127.6

[51] Int. Cl.[2] ..... D06M 3/06; D06M 3/08

[58] Field of Search ..... 8/128 R, 127.6, 127.51

[56] References Cited

UNITED STATES PATENTS 3,628,909 12/1971 Goldberg et al. ..... 8/127.6

*Primary Examiner*—John Kight, III

*Attorney, Agent, or Firm*—Young & Thompson

[57] ABSTRACT

A wool oxidation liquor contains a halogenated isocyanuric acid or salt thereof as halogen donor, a wetting agent, and an hydrogen donor comprising a mixture of a mineral acid and suitable organic acid. The halogenated isocyanuric acid may be a halogenated one, and is preferably selected among dichloroisocyanuric acid and alkali metal salts thereof, for example potassium and sodium salts. The organic acid may be selected among propionic acid, acetic acid, and halogeno-acetic acids, the mineral acid among hydrochloric, sulphuric, nitric, and orthophosphoric acid. The pH range of the liquor is in the range 0.5 to 3.5, preferably 1 to 2, and the active chlorine content in the range 0.5 to 5 per cent, preferably 1 to 2 per cent.

5 Claims, No Drawings

OXIDATION OF WOOL AND LIKE KERATIN FIBRES

This invention relates to the oxidation of wool and like keratin fibres (hereinafter referred to collectively as 'wool'). The wool may be in the form of yarns or tops, or in the form of a woven or knitted fabric containing or consisting of wool.

It is known to pretreat wool to impart shrink-resistance to it by contacting the wool fibres with a solution containing a suitable halogen-donor, followed by a coating with a suitable resin. Suitable donors are for example hypochlorites such as sodium hypochlorite, and halogenated cyanuric acids and salts thereof, such as for example the alkali metal dichloroisocyanurates.

The pH of the solution is preferably as low as possible. The alkali metal isocyanurates normally dissolve in water to produce a solution of the order of pH 6, and in order to lower the pH it has been proposed to add amounts of suitable mineral or strong organic acids to the solution. (see the specification for British Pat. No. 1 098 582).

The reason for the desirability of a low pH is that at the normal pH of about 6 the wool being treated tends to be discoloured by the chlorinating reagent to take on a yellow colour. At low pH values, this does not occur.

In addition, the lower the pH of an aqueous solution of a chlorinated isocyanuric acid or salt thereof, the better is the controlled liberation of free available chlorine, and hence the formation of hypochlorous acid.

However, at low pH values, the above chlorinating agents tend to precipitate from solution. Thus in the range 2.0 to 4.0 solutions of alkali metal dichloroisocyanurates where the pH has been reduced by addition of a mineral acid, or of a strong organic acid, are unstable and must be used soon after preparation. Hence short times between renewals of batches of solutions and short processing times, are essential. Below these pH values the position worsens. Precipitation generally takes place too rapidly after mixing for the solution to be useful.

According to the present invention, there is provided a pH regulating additive for a wool oxidation liquor containing as the halogen donor an halogenated isocyanuric acid or salt thereof, comprising a mixture of a mineral acid and suitable organic acid.

Further according to the invention, there is provided a wool oxidation liquor containing a halogen donor comprising an halogenated isocyanuric acid or salt thereof, a wetting agent, and a hydrogen ion donor comprising a mixture of a mineral acid and suitable organic acid.

The liquor suitably contains sufficient halogen donor to provide 0.5 to 5% active chlorine, 1 to 2% active chlorine being the preferred amount. (The term, and the determination of, "active chlorine" are well known in the art).

The pH for practical purposes may be in the range 0.5 to 3.5, but a pH in the range 1 to 2 is preferred.

The invention also provides a method for regulating the pH of a wool oxidation liquor containing as the halogen donor an halogenated isocyanuric acid or salt thereof comprising the step of adding the additive set out above to the liquor, and a method for oxidising wool comprising treating it with the liquor set out above.

The halogen donor may be a chlorinated isocyanuric acid, for example dichloroisocyanuric acid, or an alkali metal salt, for example potassium or sodium dichloroisocyanurate.

The organic acid may be any suitable organic acid. By suitable is meant that the acid must not be one which is readily chlorinated or oxidised. Suitable organic acids are for example propionic acid, acetic acid, and halogeno-acetic acids, for example mono-, di-, and tribromo-, fluoro-, and chloro-acetic acids.

The mineral acid may be for example hydrochloric acid, sulphuric acid, nitric acid or orthophosphoric acid.

The wetting agent should be one that is not readily attacked by oxygen, for example a non-ionic wetting agent such as one of the agents sold under the trade name TERGITOL (Regd TM).

One form of a process whereby wool or woollen material may be treated for shrink resistance with the treatment liquor of the invention is briefly as follows: The liquor is contained in a predetermined amount in a trough formed by a juxtaposed pair of rollers, closed at both ends. The wool or woollen material is passed through the liquor at a predetermined rate, the wetted out material being passed between the nip of the pair of rollers. The rate is such that the contact time of wool with liquor in the trough is in the range 0.5 to 2 seconds, preferably 1 second. Wool damage occurs with longer times. The nip is adjusted so as to ensure that the padded material retains a sufficient volume of the treatment liquor to impart to the material a predetermined shrink resistance within a predetermined time. The amount of liquor retained is referred to in the art as the "pick-up" of liquor, and is given as a percentage of the weight of the woollen material. The material having been padded with liquor as described above, the liquor picked up is then allowed to remain in contact with the material for a time sufficient for the desired shrink resistance to be imparted thereto.

In another process, the treatment liquor may be sprayed into the material for treatment, which is then padded through suitably adjusted rollers as described above.

The advantage of adding a mixture of a mineral acid and an organic acid to a wool treatment liquor of the type discussed above is that even at low pH values, for example as low as 1 to 2, a relatively stable solution has been found to result. The instability encountered in the prior art when mineral acids alone were used to lower the pH value is avoided, and it is no longer necessary to work with very short processing times. An even greater advantage is that stable solutions result even at pH values in the range 1 to 2. Such levels are wholly impracticable if a mineral acid alone is used, for precipitation occurs almost immediately, leaving no time to operate with even the shortest processing times. In the case of the present invention, however, solutions at pH 1 to 2 have been observed to remain stable for times from about half an hour to times well in excess of this amount. The advantages of working at a low pH are therefore attainable. Liberation of free halogen from the halogen donor is optimum in the pH range 1 to 2 enabling one to work at low liquor/solids ratios as compared with conventional processes. As a result, the quality of the product is significantly improved. Ratios in the range 1:05 to 1 : 5 are attainable, which is highly desirable, the preferred ratio being 1 : 1. The invention is discussed further with reference to the following Examples, which serve to illustrate, but not to limit, the invention.

EXAMPLE 1

Potassium dichloroisocyanurate (25 g) was dissolved in 860.7 g water and 5 g wetting agent was added to the solution. The solution was then acidified to pH 1.9 with a mixture consisting of 100 g glacial acetic acid and 9.3 g 18 N sulphuric acid. Wool was padded with this solution to a 100% wet pick-up, stored for 3 minutes and then neutralised and dechlorinated with a solution containing 3% sodium bicarbonate and 3% sodium bisulphite, rinsed in water and dried.

EXAMPLE 2

Potassium dichloroisocyanurate (25g) was dissolved in 857.5g water and 5g wetting agent was added to the solution. The solution was then acidified to pH 2 with a mixture consisting of 100g glacial acetic acid and 12.5g concentrated hydrochloric acid (35.5%). Wool was then treated with this solution, as described in Example 1.

EXAMPLE 3

Potassium dichloroisocyanurate (25g) was dissolved in 849g water and 5g wetting agent was added to the solution. The solution was then acidified to pH 2 with a mixture consisting of 100g glacial acetic acid and 21g of concentrated nitric acid (70%). Wool was then treated with this solution, as described in Example 1.

EXAMPLE 4

Potassium dichloroisocyanurate (25g) was dissolved in 843.6g water and 5g wetting agent was added to this solution. The solution was then acidified to pH 2 with a mixture consisting of 100g glacial acetic acid and 26.5g orthophosphoric acid (98%). Wool was then treated with this solution, as described in Example 1.

EXAMPLE 5

Potassium dichloroisocyanurate (25g) was dissolved in 857.5g water and 5g wetting agent was added to this solution. The solution was then acidified to pH 2 with a mixture consisting of 100g propionic acid and 12.5g concentrated hydrochloric acid (35.5%). Wool was then treated with this solution, as described in Example 1.

EXAMPLE 6

Potassium dichloroisocyanurate (25g) was dissolved in 860.2g water and 5g wetting agent was added to this solution. The solution was then acidified to pH 2 with a mixture consisting of 100g propionic acid and 9.8g concentrated nitric acid (70%). Wool was then treated with this solution, as described in Example 1.

In each of the above examples, a product having excellent properties resulted, the wool having been uniformly oxidised. This result is attributable to the low liquor/solids ratio at which it was possible to work owing to the low pH at which the addition of the mixture of the relevant organic acid and mineral acid made it possible to operate.

In addition, very little yellowing of the wool was observed.

We claim:

1. A wool oxidation liquor consisting essentially of an aqueous solution of a halogenated isocyanuric acid or salt thereof as halogen donor, a wetting agent, and a hydrogen donor comprising a mixture of an organic acid selected from the group consisting of propionic acid, acetic acid and halogenoacetic acid and a mineral acid selected from the group consisting of hydrochloric acid, sulphuric acid, nitric acid and orthophosphoric acid, the organic acid being present in an amount which is greater than the amount of the mineral acid and which is effective to retard precipitation of said halogen donor from said liquor as compared to a liquor in which said mineral acid is present without said organic acid, the pH of the liquor being in the range 0.5 to 3.5 and the active chlorine content being in the range 0.5 to 5 per cent.

2. A wool oxidation liquor as claimed in claim 1, in which said pH is in the range 1 to 2.

3. A wool oxidation liquor as claimed in claim 1, in which said active chlorine content is in the range 1 to 2 per cent.

4. A wool oxidation liquor as claimed in claim 1, in which said halogen donor is selected from the group consisting of chlorinated isocyanuric acid and an alkali metal salt thereof.

5. A method for oxidizing wool, comprising the step of contacting wool with the oxidation liquor of claim 1, at a liquor/solids ratio in the range 1:0.5 to 1:5.

* * * * *